US007462059B2

(12) United States Patent
Saito et al.

(10) Patent No.: US 7,462,059 B2
(45) Date of Patent: Dec. 9, 2008

(54) CONNECTOR

(75) Inventors: Yuichi Saito, Tokyo (JP); Tadahiro Ota, Tokyo (JP)

(73) Assignee: Japan Aviation Electronics Industry Limiited, Tokyo (JP)

( * ) Notice: Subject to any disclaimer, the term of this patent is extended or adjusted under 35 U.S.C. 154(b) by 0 days.

(21) Appl. No.: 11/640,752

(22) Filed: Dec. 18, 2006

(65) Prior Publication Data

US 2007/0149032 A1 Jun. 28, 2007

(30) Foreign Application Priority Data

Dec. 28, 2005 (JP) ..... 2005-379819

(51) Int. Cl.
*H01R 4/24* (2006.01)

(52) U.S. Cl. ..... 439/397

(58) Field of Classification Search ..... 439/397, 439/541.5, 79, 607–610, 101, 108, 941
See application file for complete search history.

(56) References Cited

U.S. PATENT DOCUMENTS 6,050,863 A * 4/2000 Noda ..... 439/856
6,575,789 B2 * 6/2003 Bassler et al. ..... 439/609
6,835,091 B2 * 12/2004 Oleynick et al. ..... 439/541.5
6,863,549 B2 * 3/2005 Brunker et al. ..... 439/108

FOREIGN PATENT DOCUMENTS

JP 2002-334748 A 11/2002

* cited by examiner

*Primary Examiner*—Edwin A. León
(74) *Attorney, Agent, or Firm*—Frishauf, Holtz, Goodman & Chick, P.C.

(57) ABSTRACT

A connector which is excellent in transmission characteristics and at the same time capable of facilitating cable-connecting operations. One contact group is comprised of a ground contact including a first contact portion and a first connection portion, a first signal contact including a second contact portion and a second connection portion, and a second signal contact including a third contact portion and a third connection portion. A plurality of the contact groups are held by a housing along a direction orthogonal to a connector fitting direction. First to third contact portions of all the contact groups are arranged on a single imaginary straight line substantially orthogonal to the connector fitting direction. The first to third connection portions are arranged such that imaginary straight lines connecting between the first to third connection portions of each contact group form an isosceles triangle, and imaginary straight lines connecting between the first connection portions of all the contact groups form one zigzag line.

1 Claim, 16 Drawing Sheets

CONNECTOR

BACKGROUND OF THE INVENTION

1. Field of the Invention

This invention relates to a connector, and more particularly to a connector suitable for high-speed transmission.

2. Prior Art

Conventionally, there has been proposed a connector which is suitable for high-speed transmission, and is provided with contact groups and a housing (see Japanese Laid-Open Patent Publication (Kokai) No. 2002-334748, Paragraph numbers [0018] and [0019], FIG. 3).

Each of the contact groups is comprised of a ground contact, a positive signal contact, and a negative signal contact. The ground contact has a first contact portion and a first connection portion. The positive signal contact has a second contact portion and a second connection portion. The negative signal contact has a third contact portion and a third connection portion. The contact groups are held in the housing. The first to third contact portions and the first to third connection portions of the contact groups are arranged in the direction of the width of the housing. The pitch of the first to third connection portions is 1.5 times as large as that of the first to third contact portions.

Recently, the diameter of a cable tends to be increased so as to enhance the transmission characteristics of the connector. In the above-described connector, however, the pitch of the first to third connection portions is only 1.5 times as large as that of the first to third contact portions, and hence the connector suffers from the problem that when cables having a large diameter are used, it is difficult to perform connecting operations. Although it is possible to increase the pitch of the first to third connection portions by increasing the size of the housing, this undesirably increases the size of the connector. Further, although it is possible to increase the pitch of the first to third connection portions by arranging the first to third connection portions in two rows on alternately staggered arrangement, this results in degradation of the transmission characteristics of the connector because signal pairs become adjacent to other signal pairs.

SUMMARY OF THE INVENTION

The present invention has been made in view of these problems, and an object thereof is to provide a connector which is excellent in transmission characteristics and at the same time capable of facilitating connecting operations.

To attain the above object, the present invention provides a connector comprising a housing that is capable of being fitted to a mating connector, and a plurality of contact groups each comprising a ground contact including a first contact portion and a first connection portion, a first signal contact including a second contact portion and a second connection portion, and a second signal contact including a third contact portion and a third connection portion, the contact groups being held by the housing along a direction orthogonal to a connector fitting direction, wherein the first to third contact portions of all the contact groups are arranged on a single imaginary straight line substantially orthogonal to the connector fitting direction, wherein imaginary straight lines connecting between the first to third connection portions of each contact group form an isosceles triangle, and wherein imaginary straight lines connecting between the first connection portions of all the contact groups form one zigzag line.

With this arrangement of the connector according to the invention, the imaginary straight lines connecting between the first to third connection portions of each contact group form an isosceles triangle, and the imaginary straight lines connecting between the first connection portions of all the contact groups forms one zigzag line, so that it is possible to set the arrangement pitch of the first to third connection portions to a pitch twice as large as the arrangement pitch of the first to third contact portions without increasing the width of the housing.

Preferably, the ground contacts are connected to each other.

With this arrangement of a preferred embodiment, it is possible to provide a connector which is excellent in transmission characteristics and at the same time capable of facilitating connecting operations.

Preferably, the first to third contact portions of all the contact groups are arranged on the single imaginary straight line at a predetermined pitch.

The above and other objects, features and advantages of the present invention will become more apparent from the following detailed description taken in conjunction with the accompanying drawings.

DETAILED DESCRIPTION OF THE PREFERRED EMBODIMENT

The present invention will now be described in detail with reference to the drawings showing preferred embodiments thereof.

Figure 1:
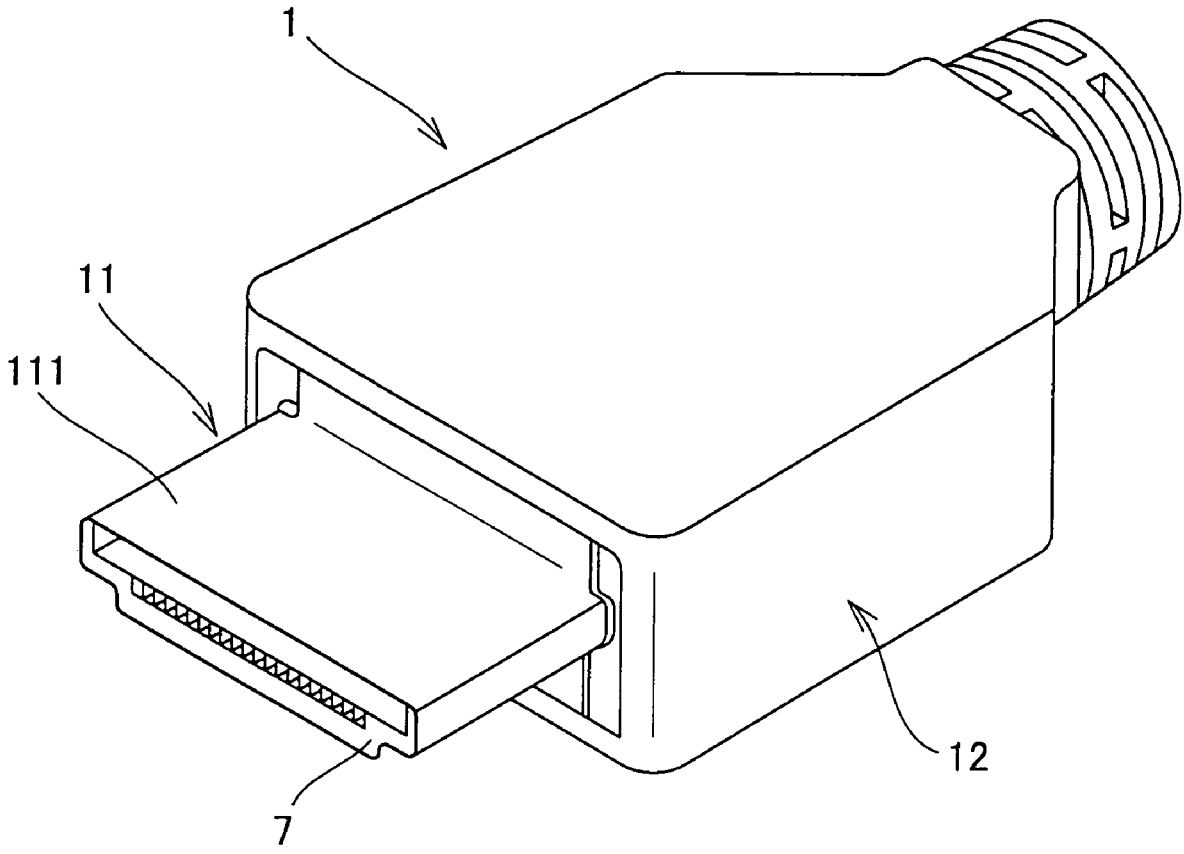
FIG. 1 is a perspective view of a plug connector according to an embodiment of the present invention.
Figure 2:
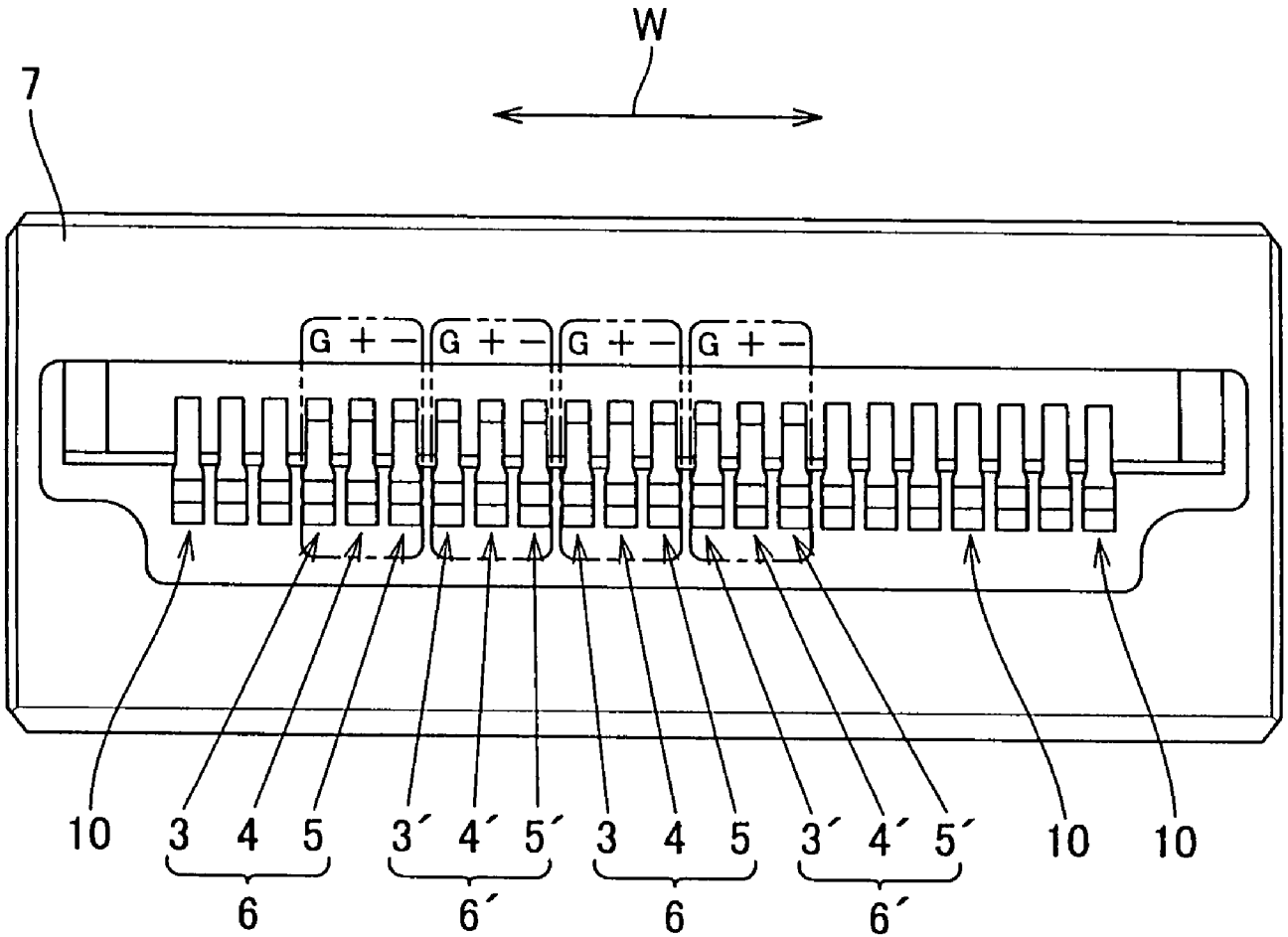
FIG. 2 is a front view of a housing and contacts of the plug connector shown in FIG. 1.
Figure 3:
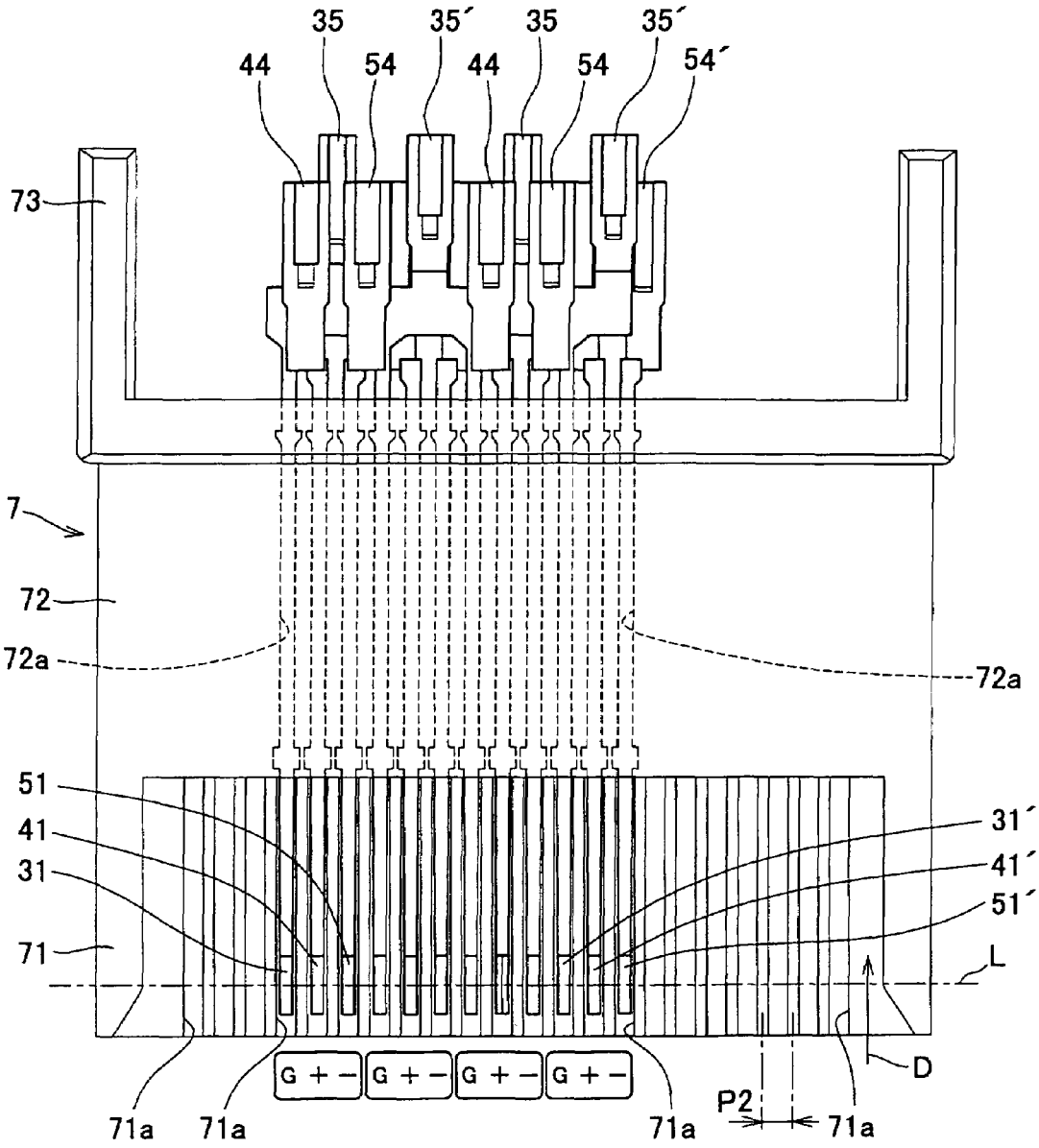
FIG. 3 is a plan view of the housing and the contacts shown in FIG. 2.
Figure 4:
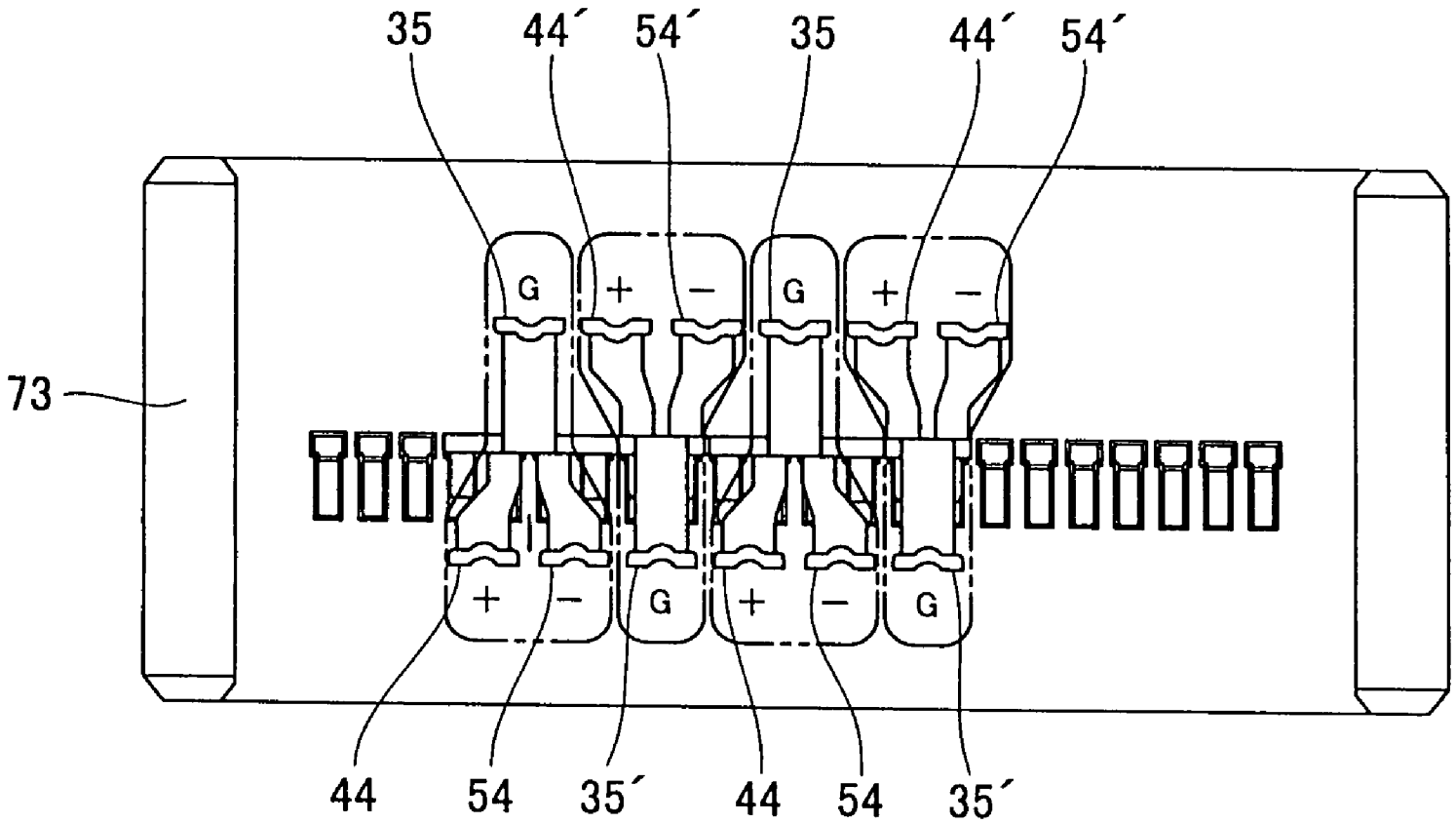
FIG. 4 is a rear view of the housing and contacts shown in FIG. 2.
Figure 5:
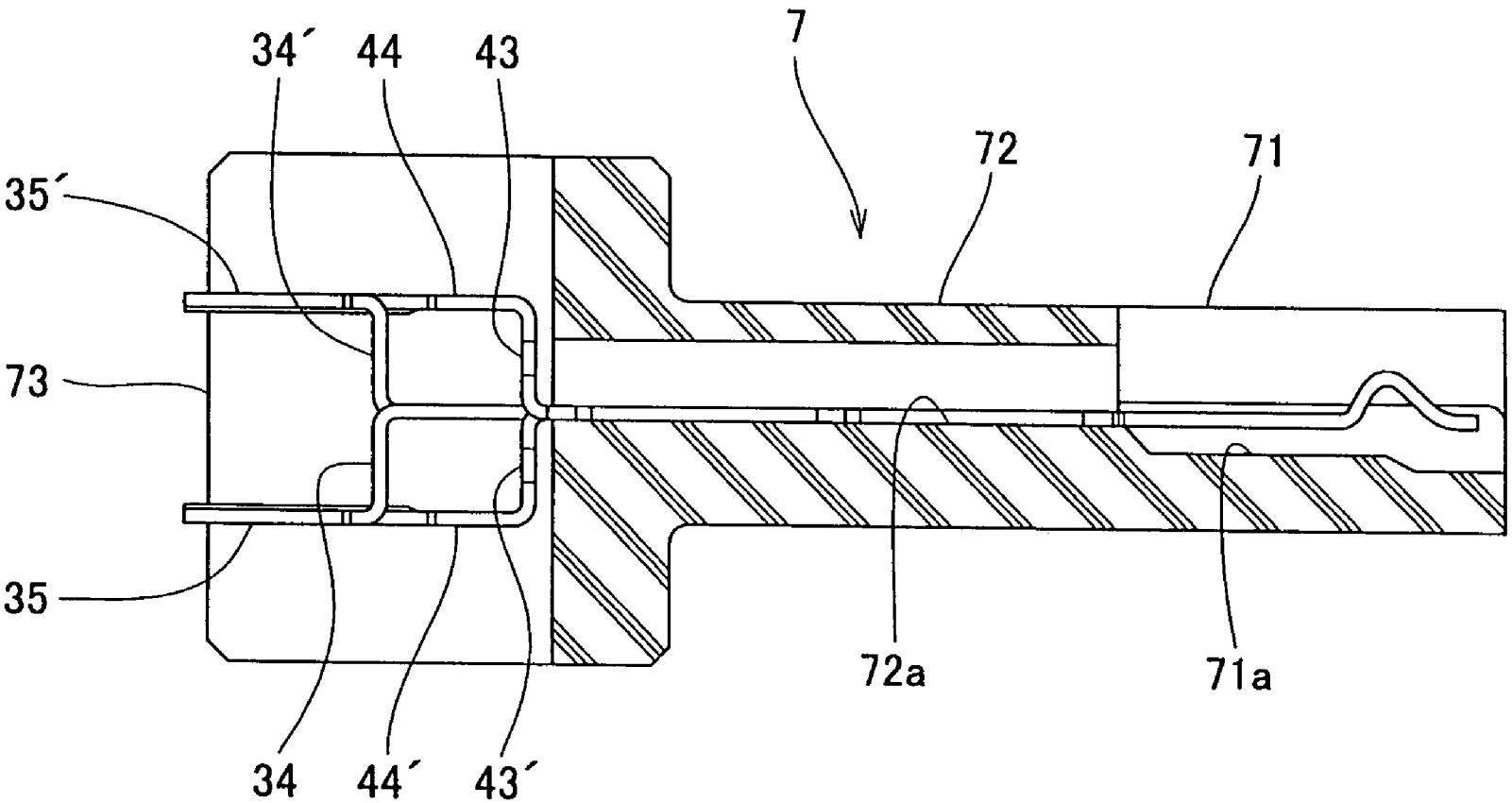
FIG. 5 is a cross-sectional view of the housing and contacts shown in FIG. 2.
Figure 6A:
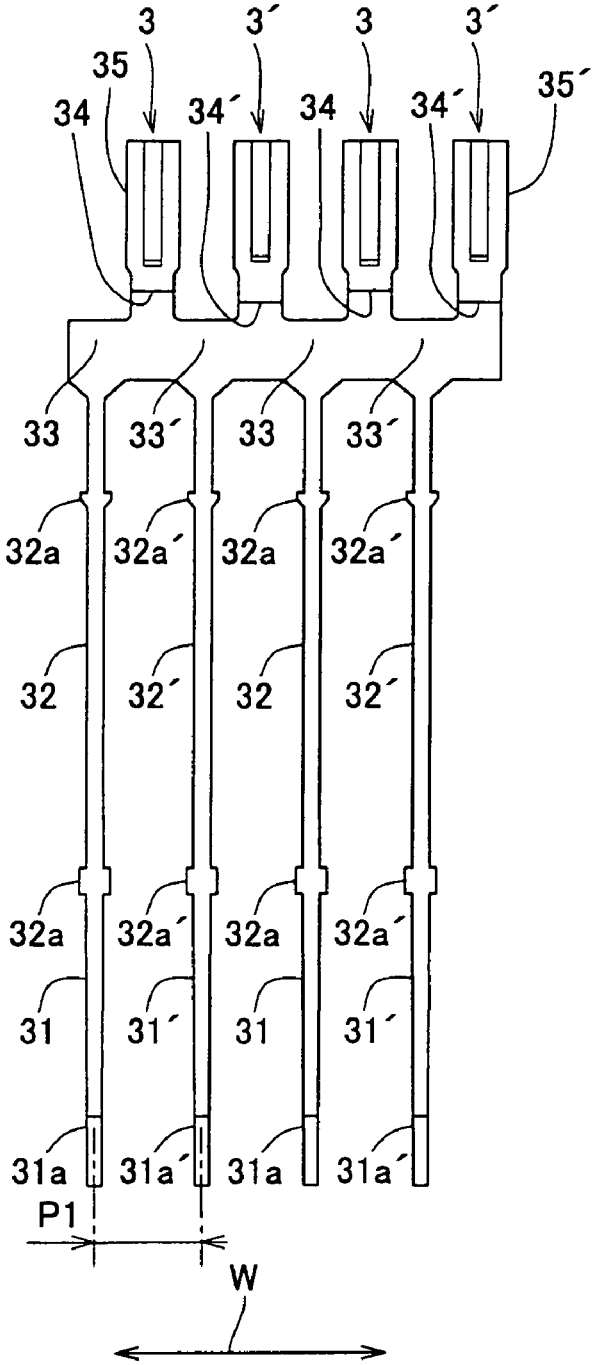
FIG. 6A is a plan view of ground contacts appearing in FIG. 3.
Figure 6B:
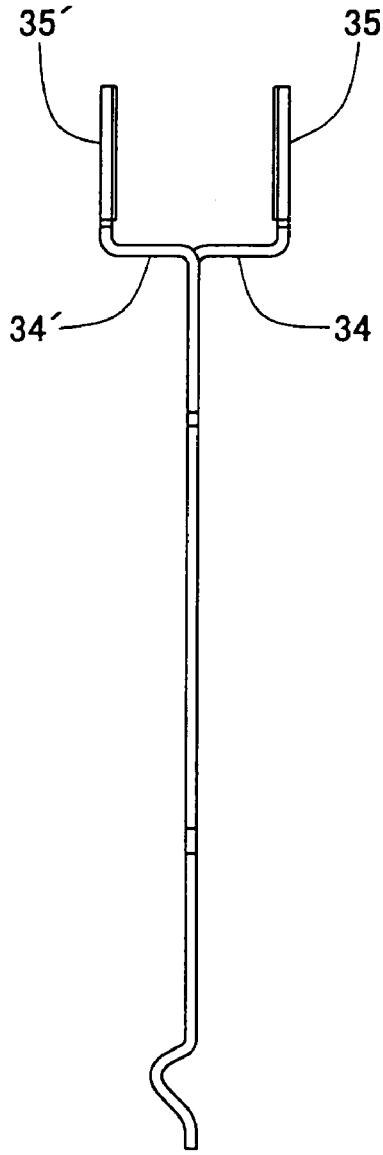
FIG. 6B is a side view of the same.
Figure 7A:
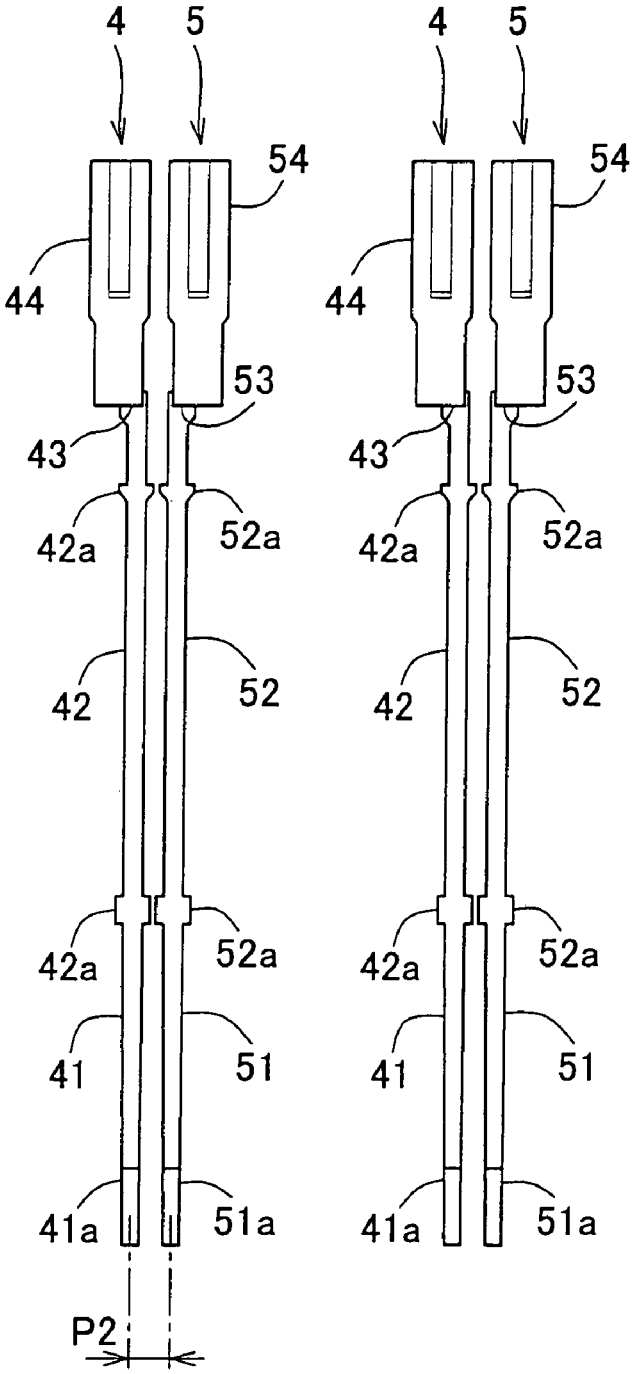
FIG. 7A is a plan view of signal contacts for upper side connection, appearing in FIG. 3.
Figure 7B:
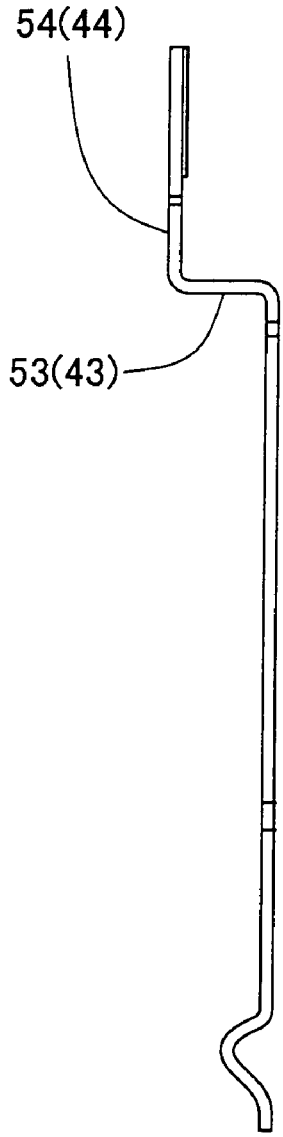
FIG. 7B is a side view of the same.
Figure 8A:
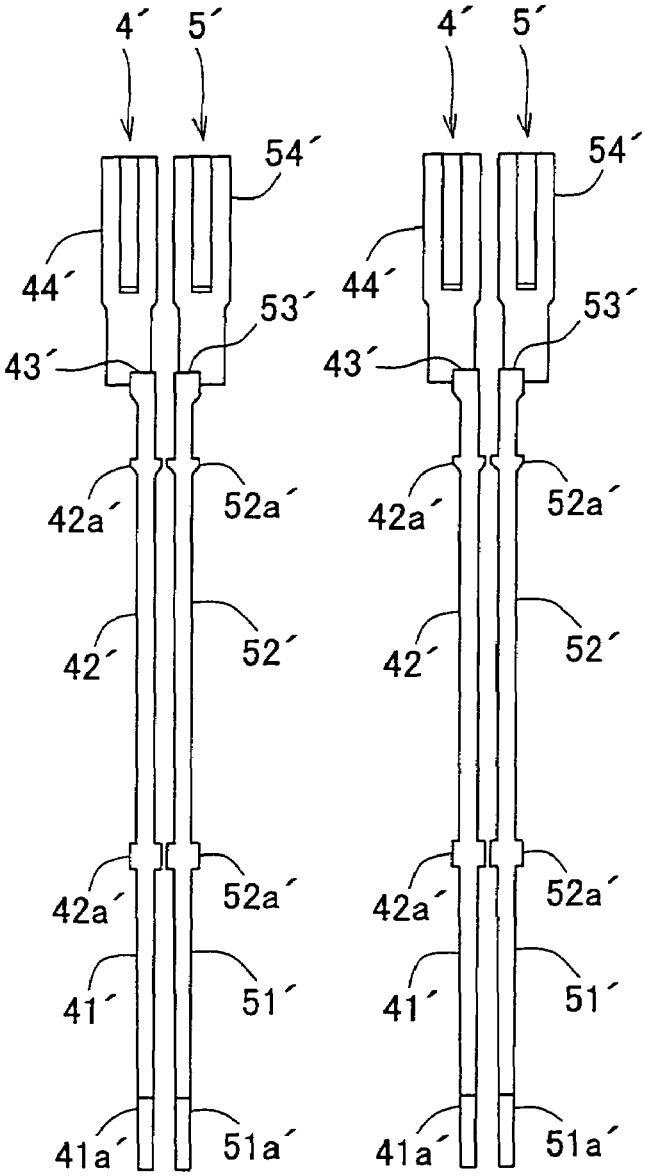
FIG. 8A is a plan view of signal contacts for lower side connection, appearing in FIG. 3.
Figure 8B:
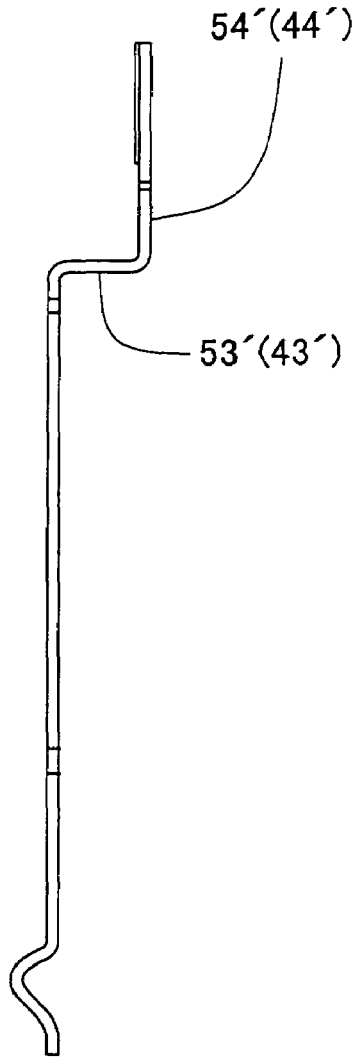
FIG. 8B is a side view of the same.
Figure 9:
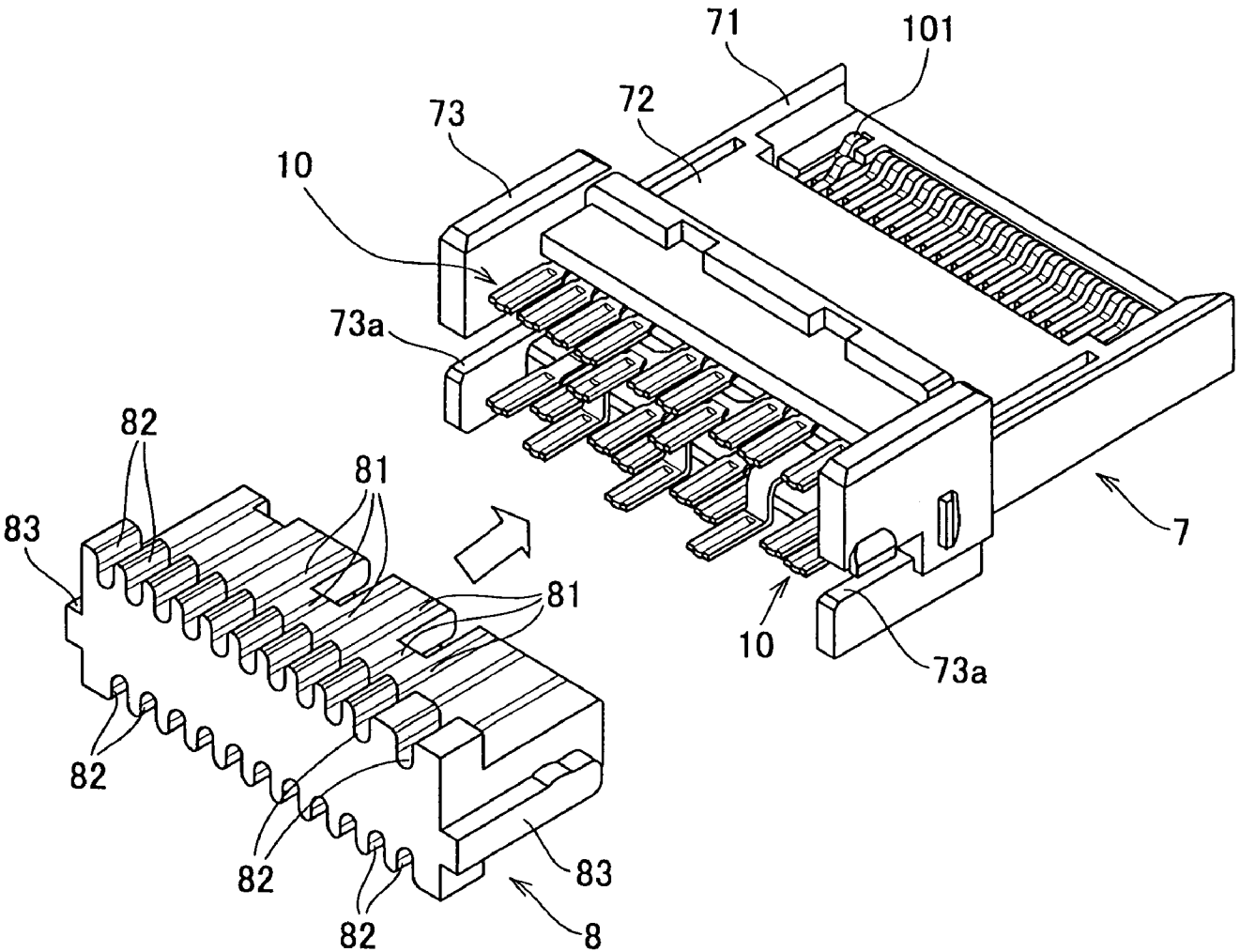
FIG. 9 is a perspective view of the housing appearing in FIG. 2 and a location plate in a state before the location plate is mounted on the housing.
Figure 10:
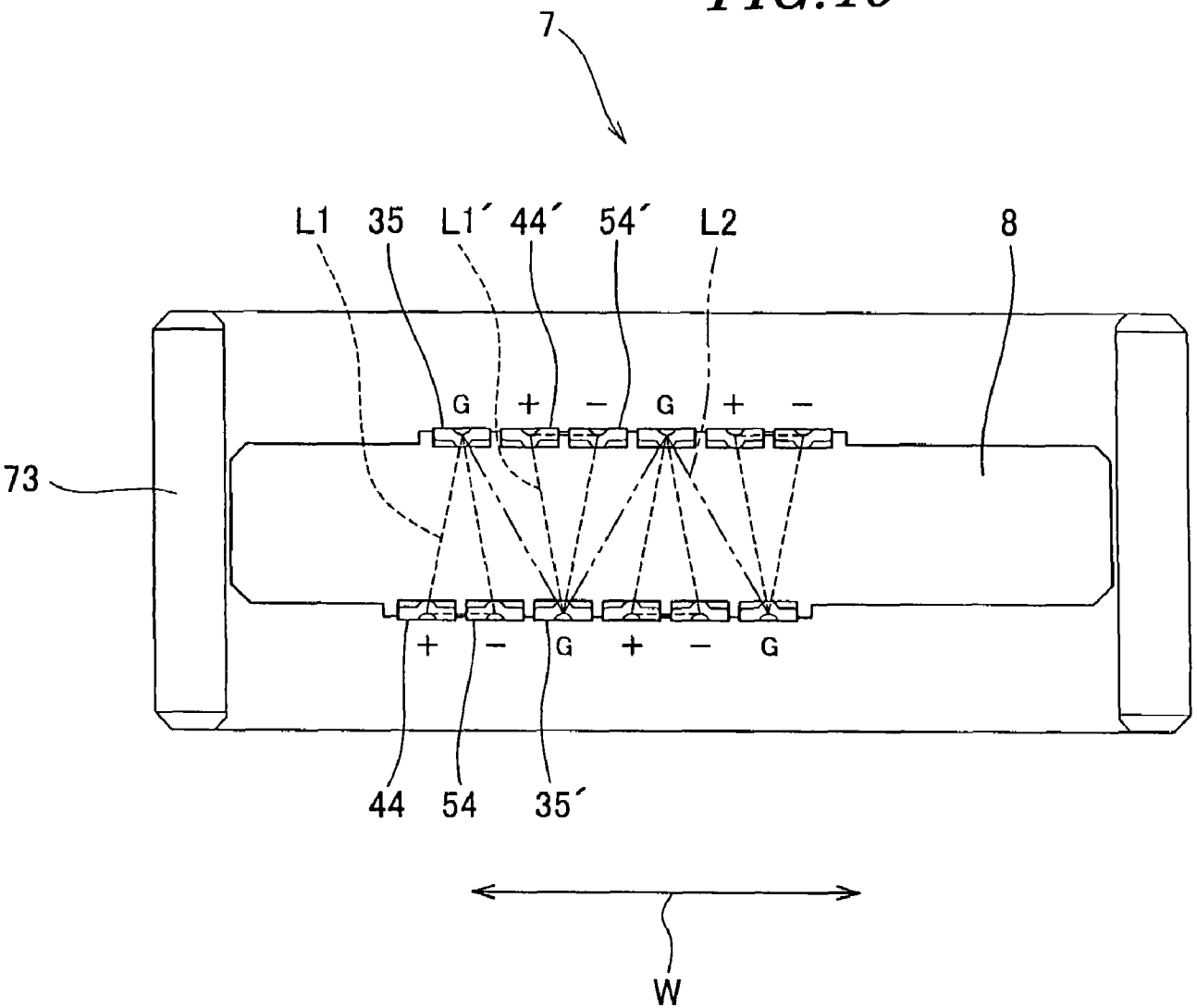
FIG. 10 is a rear view of the housing and the location plate shown in FIG. 9, in a state in which the location plate is mounted on the housing.
Figure 11:
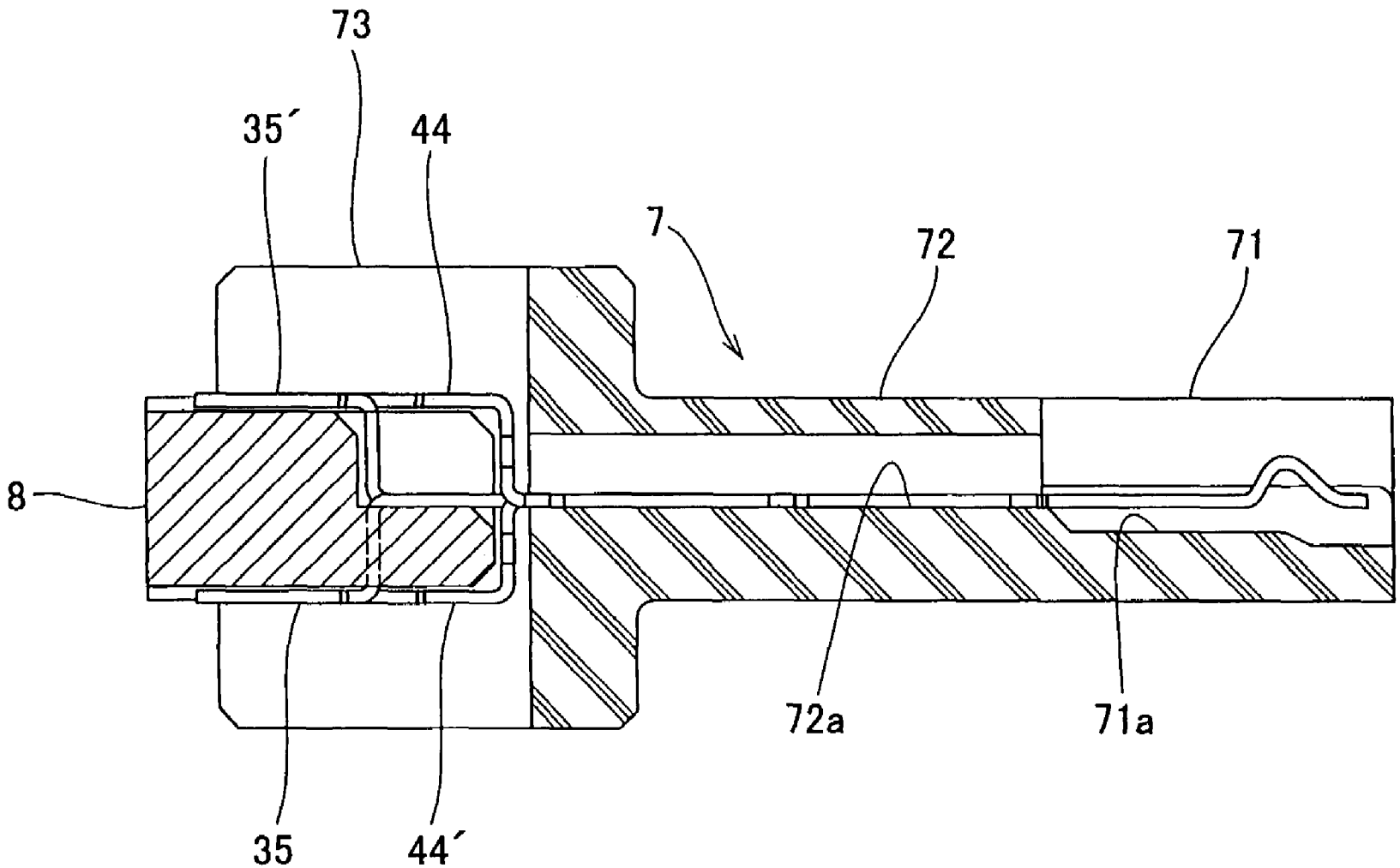
FIG. 11 is a cross-sectional view of the housing and the location plate shown in FIG. 10.
Figure 12:
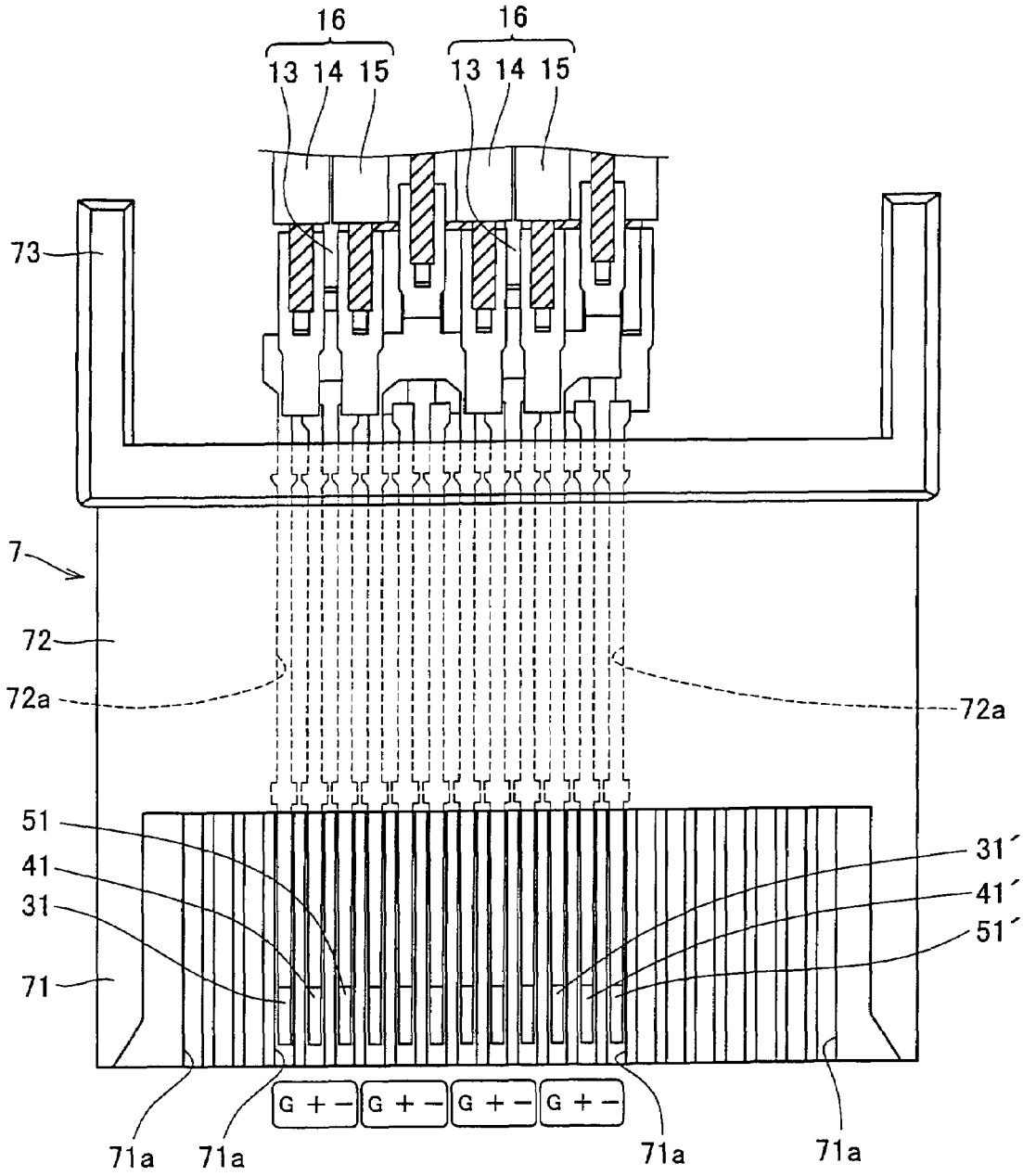
FIG. 12 is a plan view of the plug connector shown in FIG. 1 in a state in which cables are connected thereto.
Figure 13:
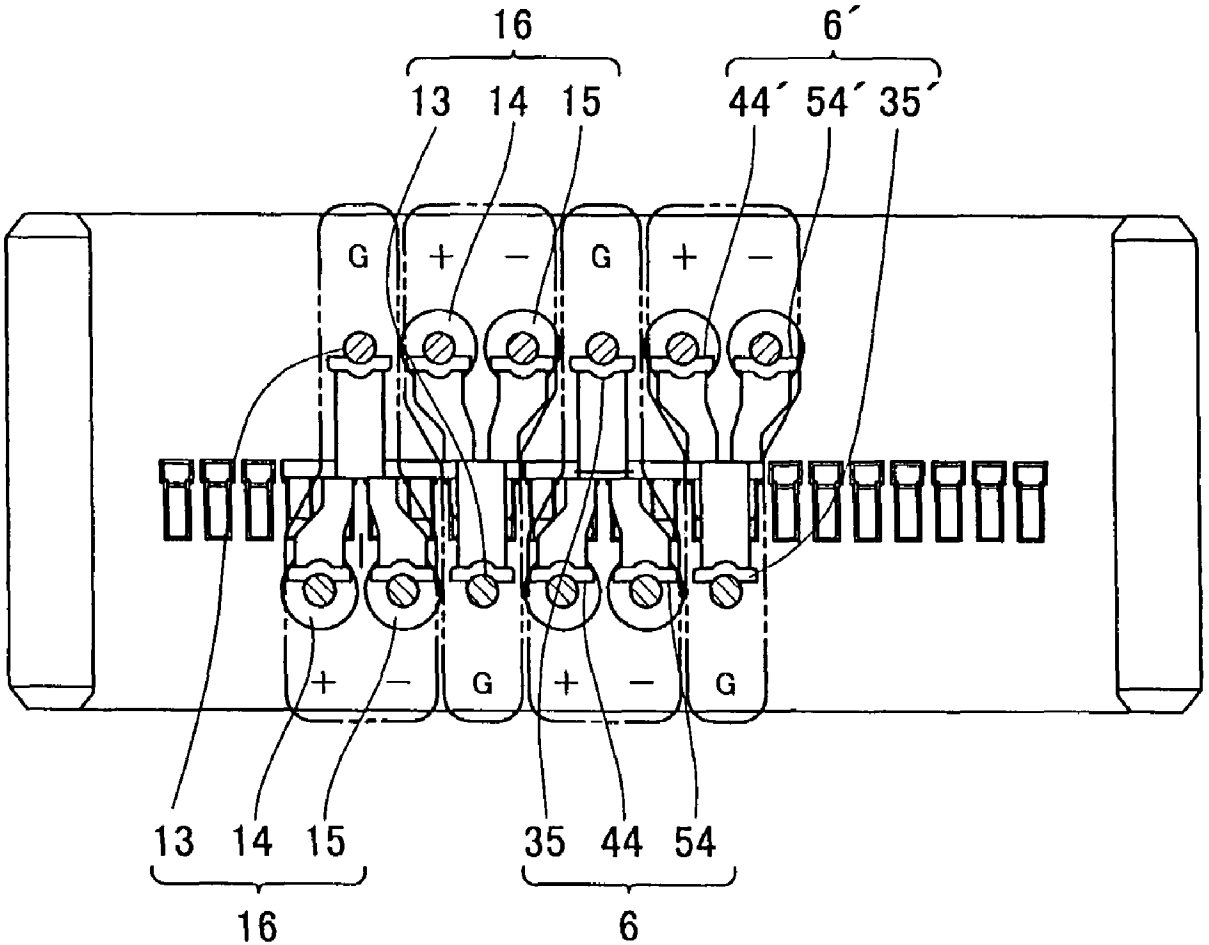
FIG. 13 is a rear view of the plug connector shown in FIG. 12.
Figure 14:
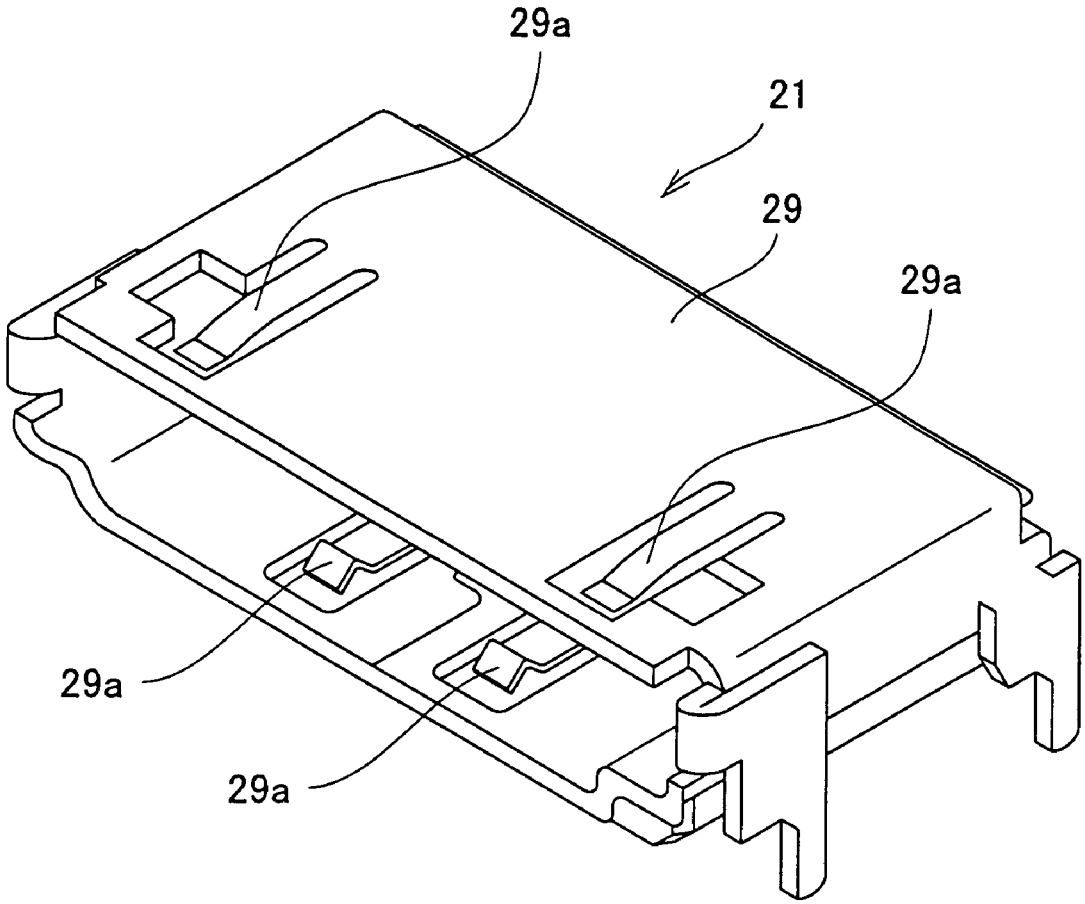
FIG. 14 is a perspective view of a circuit board-side connector, which is a mating connector associated with the plug connector shown in FIG. 12.
Figure 15:
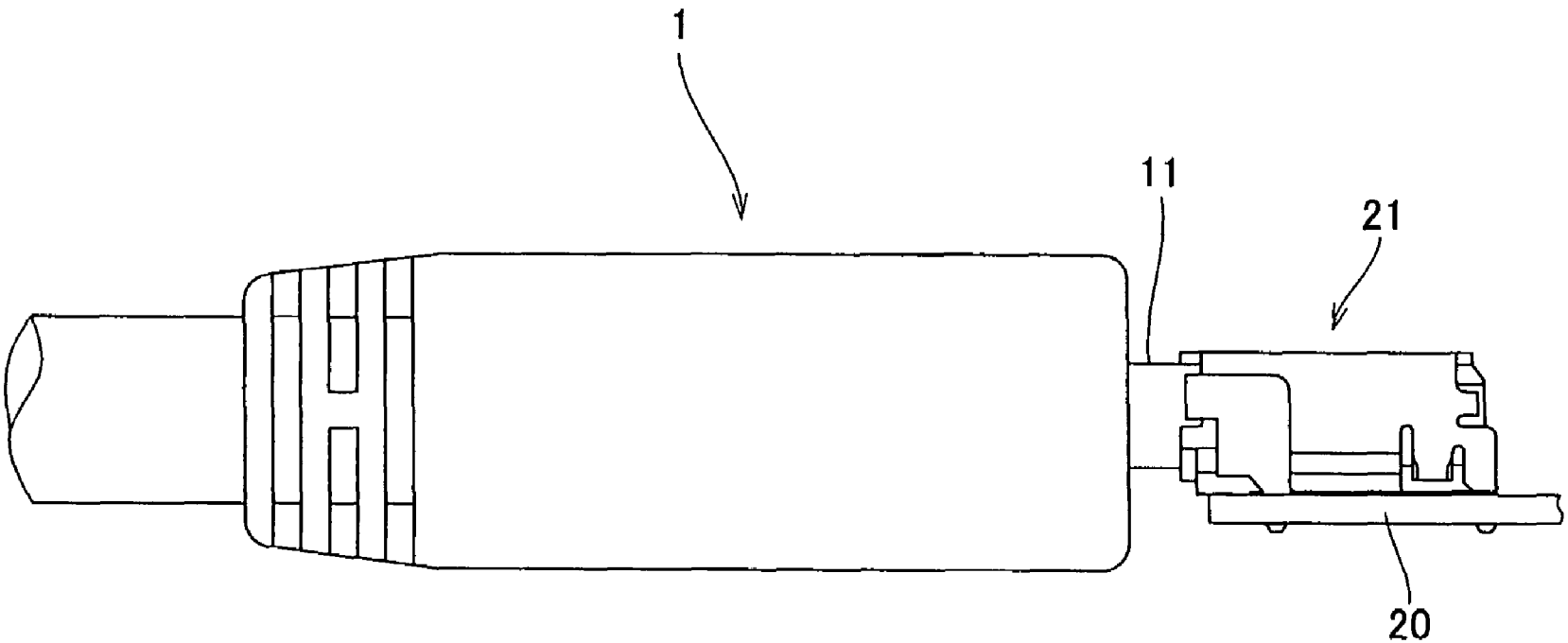
FIG. 15 is a side view of the plug connector shown in FIG. 12 and the circuit board-side connector shown in FIG. 14 in a state in which the plug connector is connected to the circuit board-side connector.
Figure 16:
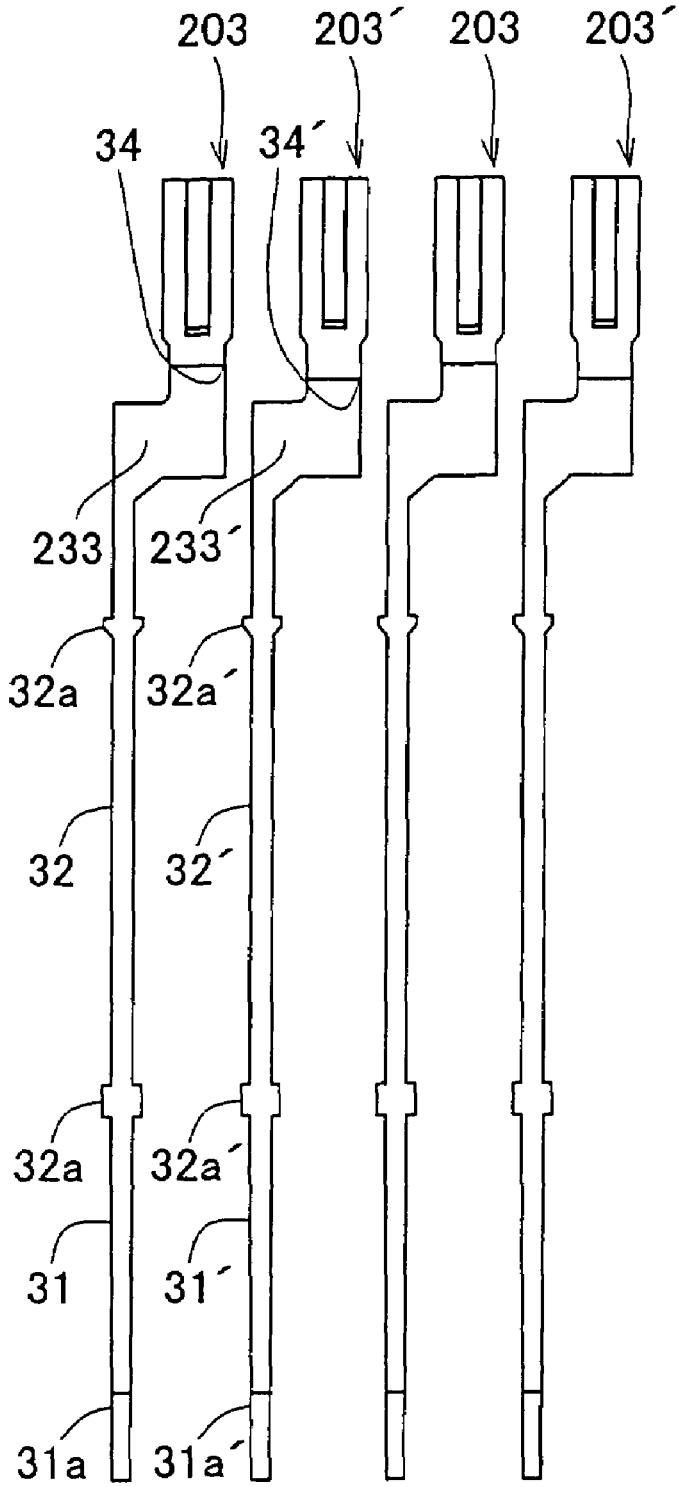
FIG. 16 is a plan view of another type of ground contacts.

FIG. 1 is a perspective view of a plug connector according to an embodiment of the present invention. FIG. 2 is a front view of a housing and contacts of the plug connector shown in FIG. 1. FIG. 3 is a plan view of the housing and the contacts shown in FIG. 2. FIG. 4 is a rear view of the housing and contacts shown in FIG. 2. FIG. 5 is a cross-sectional view of the housing and contacts shown in FIG. 2. FIG. 6A is a plan view of ground contacts appearing in FIG. 3. FIG. 6B is a side view of the same. FIG. 7A is a plan view of signal contacts for upper side connection, appearing in FIG. 3. FIG. 7B is a side view of the same. FIG. 8A is a plan view of signal contacts for lower side connection, appearing in FIG. 3. FIG. 8B is a side view of the same. FIG. 9 is a perspective view of the housing appearing in FIG. 2 and a location plate in a state before the location plate is mounted on the housing. FIG. 10 is a rear view of the housing and the location plate shown in FIG. 9, in a state in which the location plate is mounted on the housing. FIG. 11 is a cross-sectional view of the housing and the location plate shown in FIG. 10. FIG. 12 is a plan view of the plug connector shown in FIG. 1 in a state in which cables are connected thereto. FIG. 13 is a rear view of the plug connector shown in FIG. 12. FIG. 14 is a perspective view of a circuit board-side connector, which is a mating connector associated with the plug connector shown in FIG. 12. FIG. 15 is a side view of the plug connector shown in FIG. 12 and the circuit board-side connector shown in FIG. 14 in a state in which the plug connector is connected to the circuit board-side connector. FIG. 16 is a plan view of another type of ground contacts.

Referring to FIGS. 1 and 2, the plug connector (connector) 1 is comprised of a plurality of contact groups 6 and 6' (see FIG. 2), the housing 7, the location plate 8 (see FIG. 9), contacts 10, a shell 11, and a hood 12. The plug connector 1 is an interface connector for high-speed transmission.

The contact groups 6 and 6' are arranged along the direction W of the width of the housing 7. Each of the contact groups 6 and 6' forms a differential transmission line.

As shown in FIG. 2, when the contact groups 6 and 6' are counted from the left end-side of the housing 7, the contact groups 6 are located at odd numbered positions, and the contact groups 6' are located at even-numbered positions.

The contact group 6 is comprised of the ground contact 3, the signal contact (first signal contact) 4, and the signal contact (second signal contact) 5.

The ground contact 3 is elastic and generally crank-shaped. As shown in FIGS. 6A and 6B, the ground contact 3 includes a first contact portion 31, a first press-fitting portion 32, a decentering portion 33, a first crank portion 34, and a first connection portion 35. The first contact portion 31 has an arcuate first contact point 31*a*. The first press-fitting portion 32 is continuous with the first contact portion 31, and has a plurality of nails 32*a*. The decentering portion 33 is crank-shaped, and extends between the first press-fitting portion 32 and the first crank portion 34, for making the center line of the first crank portion 34 eccentric from the center line of the first contact portion 31. The direction of decentering of the first crank portion 34 by the decentering portion 33 is rightward as viewed in FIG. 6A, and the amount of decentering is approximately equal to half the arrangement pitch P1 of the first contact portions 31 and 31'. The first crank portion 34 extends between the decentering portion 33 and the first connection portion 35, and as shown in FIG. 5, serves to make the position of the first connection portion 35 lower than that of an associated press-fitting slot 72*a*, referred to hereinafter. The first connection portion 35 is continuous with the first crank portion 34.

The signal contact 4 is elastic and generally crank-shaped. As shown in FIGS. 7A and 7B, the signal contact 4 includes a second contact portion 41, a second press-fitting portion 42, a second crank portion 43, and a second connection portion 44. The second contact portion 41 has an arcuate second contact point 41*a*. The second press-fitting portion 42 is continuous with the second contact portion 41, and has a plurality of nails 42*a*. The second crank portion 43 extends between the second press-fitting portion 42 and the second connection portion 44, and as shown in FIG. 5, serves to make the position of the second connection portion 44 higher than that of the associated press-fitting slot 72*a*. The second connection portion 44 is connected to the second crank portion 43 in a state decentered therefrom. The direction of decentering of the second connection portion 44 from the second crank portion 43 is leftward as viewed in FIG. 7A, and the amount of decentering is equal to half the arrangement pitch P2 of accommodation grooves 71*a* (see FIG. 3), referred to hereinafter.

The signal contact 5 is elastic and generally crank-shaped. As shown in FIGS. 7A and 7B, the signal contact 5 includes a third contact portion 51, a third press-fitting portion 52, a third crank portion 53, and a third connection portion 54. The third contact portion 51 has an arcuate third contact point 51*a*. The third press-fitting portion 52 is continuous with the third contact portion 51, and has a plurality of nails 52*a*. The third crank portion 53 extends between the third press-fitting portion 52 and the third connection portion 54, and similarly to the second crank portion 43, serves to make the position of the third connection portion 54 higher that of the associated press-fitting slot 72*a*. The third connection portion 54 is connected to the third crank portion 53 in a state decentered therefrom. The direction of decentering of the third connection portion 54 from the third crank portion 53 is rightward as viewed in FIG. 7A, and the amount of decentering is equal to half the arrangement pitch P2 of the accommodation grooves 71*a* (see FIG. 3).

The contact group 6' is comprised of a ground contact 3', a signal contact (first signal contact) 4', and a signal contact (second signal contact) 5'.

As shown in FIGS. 6A and 6B, in the present embodiment, the ground contact 3' is integrally formed with the ground contact 3. The ground contact 3' includes a first contact portion 31', a first press-fitting portion 32', a decentering portion 33', a first crank portion 34', and a first connection portion 35'. These portions except the first crank portion 34' are constructed similarly to the first contact portion 31, the first press-fitting portion 32, the decentering portion 33, and the first connection portion 35 of the ground contact 3, and hence detailed description thereof is omitted.

The first crank portion 34' extends between the decentering portion 33' and the first connection portion 35', and as shown in FIG. 5, serves to make the position of the first connection portion 35' higher than that of the associated press-fitting slot 72*a*.

As shown in FIGS. 8A and 8B, the signal contact 4' includes a second contact portion 41', a second press-fitting portion 42', a second crank portion 43', and a second connection portion 44'. These portions except the second crank portion 43' are constructed similarly to the second contact portion 41, the second press-fitting portion 42, and the second connection portion 44 of the signal contact 4, and hence detailed description thereof is omitted.

The second crank portion 43' extends between the second press-fitting portion 42' and the second connection portion 44', and as shown in FIG. 5, serves to make the position of the second connection portion 44' lower than that of the associated press-fitting slot 72*a*.

As shown in FIGS. 8A and 8B, the signal contact 5' includes a third contact portion 51', a third press-fitting portion 52', a third crank portion 53', and a third connection portion 54'. These portions except the third crank portion 53' are constructed similarly to the third contact portion 51, the third press-fitting portion 52, and the third connection portion 54 of the signal contact 5, and hence detailed description thereof is omitted.

The third crank portion 53' extends between the third press-fitting portion 52' and the third connection portion 54', and similarly to the second crank portion 43', serves to make the position of the third connection portion 54' lower than that of the associated press-fitting slot 72*a*.

As shown in FIGS. 3 and 5, the housing 7 is comprised of a receiving portion 71, a contact holding portion 72, and an accommodating portion 73.

The receiving portion 71 receives respective contact portions of contacts (not shown) of a circuit board-side connector 21 (see FIG. 14). Further, the receiving portion 71 has a plurality of accommodation grooves 71*a* formed therein on a single imaginary straight line L substantially orthogonal to a connector fitting direction D, at the predetermined pitch P2. The accommodation grooves 71*a* extend in the connector fitting direction D. The accommodation grooves 71*a* accommodates the first contact portion 31, the second contact portion 41, the third contact portion 51, the first contact portion 31', the second contact portion 41', the third contact portion 51', and respective contact portions 101 (see FIG. 9) of the contacts 10 in a line along the direction W of the width of the housing 7.

The contact holding portion 72 is formed with the press-fitting slots 72*a* continuous with the accommodation grooves 71*a*. In the press-fitting slots 72*a* are press-fitted the first press-fitting portion 32, the second press-fitting portion 42, the third press-fitting portion 52, the first press-fitting portion 32', the second press-fitting portion 42', the third press-fitting portion 52', and respective press-fitting portions of general-signal contacts and the like.

As shown in FIGS. 9 to 13, the accommodating portion 73 accommodates the first connection portion 35, the second connection portion 44, the third connection portion 54, the first connection portion 35', the second connection portion 44', and the third connection portion 54'. Further, the accommodating portion 73 accommodates ends of twinax cables 16, and the location plate 8. The accommodating portion 73 is formed with holding slots 73*a*.

The location plate 8 has upper and lower surfaces formed with holding grooves 81. The holding grooves 81 hold the connection portions 35, 44, 54, 35', 44', and 54'. Further, the location plate 8 has cable-holding portions 82 formed in the upper and lower surfaces thereof. The cable-holding portions 82 hold the twinax cables 16. The location plate 8 has protrusions 83 formed on opposite side surfaces thereof. The protrusions 83 are inserted into the holding slots 73*a* and are held by the accommodating portion 73. Thus, the location plate 8 is mounted on the accommodating portion 73 of the housing 7.

The contacts 10 are used as contacts for general signals, power supply, and the like.

The shell 11 is electrically conductive, and covers the housing 7, as shown in FIG. 1.

The hood 12 has insulating properties, and covers the shell 11 except for a contact portion 111 of the shell 11.

As shown in FIGS. 12 and 13, each twinax cable 16 is comprised of a drain line 13, a positive signal line 14, and a negative signal line 15. The drain line 13 is connected to the first connection portion 35 or 35'. The signal line 14 is connected to the second connection portion 44 or 44'. The signal line 15 is connected to the third connection portion 54 or 54'.

Next, the pin assignment of the connection portions 35, 44, and 54 of each contact group 6, and the pin assignment of the connection portions 35', 44', and 54' of each contact group 6' will be described with reference to FIGS. 4 and 10. Imaginary straight lines L1 connecting between the connection portions 35, 44, and 54 form an isosceles triangle. Although imaginary straight lines L1' connecting between the connection portions 35', 44', and 54' also form an isosceles triangle, the orientation of this isosceles triangle and the orientation of the isosceles triangle formed by the imaginary straight lines L1 connecting between the connection portions 35, 44, and 54 are opposite to each other. Further, imaginary straight lines L2 connecting between the connection portions 35 and 35' are in a zigzag form. More specifically, the bottoms of isosceles triangles formed by the imaginary straight lines L2 are alternately arranged in a staggered fashion. The connection portions 35, 44, 54, 35', 44', and 54' are arranged in two rows along the direction W of the width of the housing 7.

Referring to FIGS. 14 and 15, the circuit board-side connector 21, which is a mating connector associated with the plug connector 1, has a shell 29. The shell 29 has spring pieces 29*a*. When the plug connector 1 is fitted to the circuit board-side connector 21, the spring pieces 29*a* are brought into contact with the shell 11 of the plug connector 1.

The shell 29 is provided with a housing (not shown), and contact groups (not shown), similarly to the plug connector 1.

The circuit board-side connector 21 is mounted on a printed circuit board 20.

According to the plug connector of the present embodiment, since the connection portions 35, 44, 54, 35', 44', and 54' are arranged in two rows, it is possible to make the arrangement pitch of the connection portions 35, 44, 54, 35', 44', and 54' twice as large as that of the contact portions 31, 41, 51, 31', 41', and 51' without increasing the width of the housing. This makes it possible to facilitate operations for connecting the twinax cables 16 to the contact groups of the plug connector 1.

Further, the imaginary straight lines connecting between the respective connection portions 35, 44, and 54 of the ground contact 3, the signal contact 4, and the signal contact 5 constituting each contact group 6 form an isosceles triangle, and the imaginary straight lines connecting between the respective connection portions 35', 44', and 54' of the ground contact 3', the signal contact 4', and the signal contact 5' constituting the contact group 6' form an isosceles triangle. Therefore, it is possible to secure a balance between transmission characteristics of the differential transmission lines.

Further, in the contact groups 6 and 6', the distances from the connection portions 35 and 35' of the ground contacts 3 and 3' to the associated connection portions 44 and 54 and 44' and 54' of respective pairs of signal contacts 4 and 5 and 4' and 5' are made equal to each other. Further, between the respective connection portions 44 and 54 of the signal contacts 4 and 5 of the contact group 6 and the respective connection portions 44 and 54 of the signal contacts 4 and 5 of the closest contact group 6 to the contact group 6, there is interposed the connection portion 35' of the ground contact 3' of the contact group 6', and similarly, between the respective connection portions 44' and 54' of the signal contacts 4' and 5' of the contact group 6' and the respective connection portions 44' and 54' of the signal contacts 4' and 5' of the closest contact group 6' to the contact group 6', there is interposed the connection portion 35 of the ground contact 3 of the contact group 6. As a result, noise can be canceled out, thereby making it possible to realize stable transmission characteristics (matching of impedance and reduction of crosstalk).

Furthermore, since the ground contact 3 and the ground contact 3' are integrally formed with each other, it is possible to easily perform operations for press-fitting the ground contacts 3 and 3' in the housing 7.

Although the contact portions 31, 41, 51, 31', 41', and 51' are in the form of a leaf spring, they may be pin-shaped.

Further, although the present embodiment is the plug connector 1, the present invention can also be applied to a receptacle connector.

It should be noted that although in the present embodiment, the twinax cables are used, this is not limitative, but coaxial cables may be used, for example.

FIG. 16 is a plan view of another type of ground contacts.

As shown in FIG. 16, a plurality of ground contacts 203 and 203' are independent of each other. More specifically, decentering portions 233 and 233' are separated from and independent of respective adjacent decentering portions 233' and 233. Since portions of the ground contacts 203 and 203', except for the decentering portions 233 and 233' are constructed similarly to the corresponding portions of the ground contact 3, they are designated by the same reference numerals, and detailed description thereof is omitted.

It is further understood by those skilled in the art that the foregoing are the preferred embodiments of the present invention, and that various changes and modification may be made thereto without departing from the spirit and scope thereof.

What is claimed is:

1. A connector comprising:

a housing that is capable of being fitted to a mating connector along a connector fitting direction; and a plurality of contact groups, each comprising: (i) a ground contact including a first contact portion, a first connection portion, and a first crank portion between the first contact portion and the first connection portion, (ii) a first signal contact including a second contact portion, a second connection portion, and a second crank portion between the second contact portion and the second connection portion, and (iii) a second signal contact including a third contact portion, a third connection portion, and a third crank portion between the third contact portion and the third connection portion;

wherein the contact groups are housed in the housing along a direction orthogonal to the connector fitting direction;

wherein the first, second, and third contact portions of all of the contact groups are arranged on a single imaginary straight line that is substantially orthogonal to the connector fitting direction;

wherein, in each of the contact groups imaginary straight lines connecting the first, second, and third connection portions form an isosceles triangle, and imaginary straight lines connecting the first connection portions of all of the contact groups to one another form one zigzag line;

wherein the ground contacts are connected to one another; and wherein the first, second, and third contact portions of all of the contact groups are arranged on the single imaginary straight line at a predetermined pitch;

wherein the connection portions of the contact groups are provided for connection with a cable;

wherein, in each of the contact groups, the second contact portion and the third contact portion are adjacent on the imaginary straight line; and wherein for each two adjacent contact groups, the first contact portion of one of the two adjacent contact groups is interposed on the imaginary straight line between: (i) the second and third contact portions of a first one of the adjacent groups and (ii) the second and third contact portions of a second one of the groups.

* * * * *